US006572328B2

(12) United States Patent
Tremmel et al.

(10) Patent No.: US 6,572,328 B2
(45) Date of Patent: Jun. 3, 2003

(54) STEAM TURBINE AND METHOD OF FEEDING BYPASS STEAM

(75) Inventors: Alexander Tremmel, Altlussheim (DE); Patrick Welz, Darmstadt (DE)

(73) Assignee: Alstom (Switzerland) Ltd., Baden (CH)

( * ) Notice: Subject to any disclaimer, the term of this patent is extended or adjusted under 35 U.S.C. 154(b) by 0 days.

(21) Appl. No.: 09/941,915

(22) Filed: Aug. 29, 2001

(65) Prior Publication Data

US 2002/0081191 A1 Jun. 27, 2002

(30) Foreign Application Priority Data

Aug. 29, 2000 (DE) ..... 100 42 317

(51) Int. Cl.[7] ..... F01D 17/12
(52) U.S. Cl. ..... 415/1; 415/145; 415/155
(58) Field of Search ..... 415/145, 151, 415/1, 144, 155, 159, 165

(56) References Cited

U.S. PATENT DOCUMENTS 4,744,723 A * 5/1988 Hashimoto et al. ..... 415/145

FOREIGN PATENT DOCUMENTS

DE 24 27 923 1/1975

* cited by examiner

*Primary Examiner*—Edward K. Look
*Assistant Examiner*—Kimya N McCoy
(74) *Attorney, Agent, or Firm*—Laurence A. Greenberg; Werner H. Stemer; Ralph E. Locher

(57) ABSTRACT

A steam turbine for a combined gas and steam-turbine power plant process, including at least one valve arrangement for the controlled feeding of live steam into the steam turbine is disclosed. The valve arrangement has a quick-closing valve and at least one live-steam control valve assigned to the quick-closing valve. In addition, the steam turbine has a live-steam bypass, which, feeds live steam as "bypass steam" into the high-pressure region of the steam turbine through at least one bypass line and through a bypass feed assigned to each bypass line, but after the first turbine moving-blade row, as viewed downstream of the steam-turbine inlet region. At least one live-steam control valve and at least one bypass control valve are assigned to at least one quick-closing valve. Further, a method of feeding bypass steam into the steam turbine is disclosed.

20 Claims, 5 Drawing Sheets

STEAM TURBINE AND METHOD OF FEEDING BYPASS STEAM

BACKGROUND OF THE INVENTION

Field of the Invention

The present invention lies in the field of steam turbines. More particularly, it relates to a combined gas and steam turbine power plant. In addition, the present invention relates to a method of feeding bypass steam into the steam turbine.

In power plant technology, power plant types may be differentiated according to their type of power generation or according to their field of application. One power plant type includes the industrial power plant, which generates current only as a secondary product. However, the more important energy product is the heating energy or the process steam for industrial or chemical processes.

Examples of a power plant type for commercial power generation include the steam-turbine power plant or the gas-turbine power plant.

A combination of a steam-turbine process with a gas-turbine process leads to a "combined-cycle process", in which at least one gas turbine is interconnected with a steam turbine. The power-generation efficiencies, which can be achieved thereby are comparatively high. Such a combined gas and steam turbine power plant is also termed a combined-cycle power plant.

However, a disadvantage of the combined-cycle power plants is that the quantity of electricity, which can be generated, depends to a great extent on the gas turbines. Gas turbines are standardized products, whose output or power generation depends significantly on ambient conditions, such as ambient temperatures. Even including the downstream steam-turbine process, the quantity of electricity generated, for example in the summer, is only about 80% of the quantity of electricity generated in the winter.

However, it is sometimes necessary for a higher quantity of electricity to be generated even in the summer months, than which can be delivered by the combined-cycle process: for example, in the event of an increased demand for electricity, during this period due to air-conditioning units being connected to the system. In order to meet this extra demand for electricity, combined-cycle power plants having supplementary firing are used. A steam generator, also called a heat recovery boiler in combined-cycle power plants, is not only fed with hot exhaust gases from the gas turbine, but is also loaded with an additional energy input by the combustion of a fossil fuel. Accordingly, the heat recovery boiler can produce a correspondingly larger steam quantity as "live steam" and also achieve a higher live-steam pressure. The output of the steam turbine increases accordingly, but the heat recovery boiler, the live-steam lines and other components of the live-steam path must be designed in accordance with this comparatively rare, but maximum, live-steam state.

The design is therefore affected by unusual conditions. The "100% load case", at comparatively low values of the live-steam pressure, leads to a decreased efficiency of the combined-cycle power plant. In addition, the combined-cycle power plant is equipped with components of comparatively large dimensions, which are more expensive.

SUMMARY OF THE INVENTION

It is accordingly an object of the present invention to provide a steam turbine and a method of feeding bypass steam that overcome the hereinafore-mentioned disadvantages of the heretofore-known devices of this general type and that has an increased output with a comparatively low technical outlay.

With the foregoing and other objects in view, there is provided, in accordance with the present invention, a steam turbine including at least one valve arrangement, the valve arrangement having at least one quick-closing valve and at least one live-steam control valve, the live-steam control valve being assigned to the quick-closing valve is provided. A steam-turbine inlet region, a high-pressure region, and a first turbine moving-blade row, a live-steam bypass having at least one bypass line and a bypass feed are provided. The bypass feed is coupled to the bypass line. The live-steam bypass feed live steam as bypass steam into the high-pressure region, after the first turbine moving-blade row, as viewed from downstream of the steam-turbine inlet region. At least one bypass control valve is also provided. Further, both the at least one live-steam control valve and the at least one bypass control valve are assigned to the at least one quick-closing valve.

In accordance with another feature of the present invention, the at least one bypass control valve, the at least one quick-closing valve and the at least one live-steam control valve are disposed in a common valve casing.

In accordance with another feature of the present invention, the live-steam bypass includes precisely one bypass line and precisely one bypass feed.

In accordance with another feature of the present invention, the top steam turbine further includes a top steam-turbine outer casing.

In accordance with another feature of the present invention, the at least one bypass feed is disposed in the high-pressure region such that a dismantling of the bypass feed is avoided during a dismantling of the top steam-turbine outer casing.

In accordance with another feature of the present invention, there is provided at least two adjacent blade rows and a bypass inlet region. The bypass feed feeds bypass steam into the high-pressure region through the bypass inlet region. The bypass inlet region is freely selectable in an axial direction between the two adjacent blade rows.

In accordance with another feature of the present invention, there is provided a torus-like annular space, a U-shaped profile element, an inner casing, a turbine shaft section, and a blade passage disposed between the inner casing and the turbine shaft section. The torus-like annular space is defined by an outside diameter and an inside diameter.

In accordance with another feature of the present invention, the bypass steam is uniformly distributed over a circumference in the bypass inlet region by the torus-like annular space.

In accordance with another feature of the present invention, the torus-like annular space is formed by the U-shaped profile element defining a boundary of the outside diameter and at least a partial axial boundary on both sides.

In accordance with another feature of the present invention, the torus-like annular space is formed by an appropriate configuration of the inner casing for defining a boundary of the inside diameter and at least a partial axial boundary on both sides.

In accordance with another feature of the present invention, the U-shaped profile element is configured so as to be self-sealing against a partly expanded steam in the blade passage in the bypass inlet region, when a bypass-steam having a comparatively higher bypass-steam pressure in the torus-like annular space is utilized.

In accordance with another feature of the present invention, the inner casing, in the bypass inlet region, includes apertures. The apertures are disposed as at least one connection between the torus-like annular space and the blade passage. The apertures are further disposed and configured such that a homogeneous mixing of the bypass steam bypass-steam having a comparatively higher bypass-steam pressure from the torus-like annular space and the partly expanded steam in the blade passage is achieved in the bypass inlet region.

With the foregoing and other objects in view, there is provided, in accordance with the present invention, a method of feeding bypass steam into a steam turbine, which includes the steps of controlling a live steam through at least one valve arrangement, feeding the live steam via a quick-closing valve, and partially feeding the live steam to a turbine inlet region via at least one live-steam control valve. The method further includes the step of partially feeding the live steam as bypass steam to a bypass inlet region in a high-pressure region of the steam turbine via at least one bypass control valve.

In accordance with another feature of the present invention, the bypass steam is fed into a high-pressure region via a bypass line and via a bypass feed, although the bypass steam is not fed in until after a first turbine moving-blade row, which follows downstream of the steam-turbine inlet region.

In accordance with another feature of the present invention, the bypass steam is uniformly distributed over a circumference of the steam turbine by a torus-like annular space in the bypass inlet region.

In accordance with another feature of the present invention, the bypass steam is fed from a torus-like annular space into a blade passage via a plurality of apertures.

In accordance with another feature of the present invention, the method further includes the step of controlling a mixing of the bypass steam and a partly expanded steam in a blade passage by a configuration of the apertures.

In accordance with another feature of the present invention, the method further includes the step of controlling a mixing of the bypass steam and a partly expanded steam in a blade passage by a quantity and a position of the apertures.

Accordingly, the steam turbine has a quick-closing valve to which both of the at least one live-steam control valve and at least one bypass control valve are assigned. This achieves the effect that a large quantity of live steam is fed via the quick-closing valve. In this way, the live-steam pressure in the pressure generator is kept at the original pressure value, so that the steam generator advantageously need not be configured for a higher pressure.

A separate bypass quick-closing valve, which otherwise has to be connected upstream of each bypass control valve for safety reasons, is also eliminated in the configuration, according to the present invention. The quick-closing valve ensures the safety function for both of the control valves: the live-steam control valve and the bypass control valve.

Accordingly, a considerable increase in the output of the steam turbine, for example 50%, is achieved with comparatively few technical adaptations. This includes adaptations, such as the size of the quick-closing valve: technically complicated adaptations solely due to pressure, for example, thicker walls of pipes or casings, changes of materials to higher-grade steels or design adaptation of the steam turbine, are not necessary.

A further advantage is due to the improved control behavior of the steam turbine. Owing to the type of construction, live-steam control valves and bypass control valves are not completely steam-tight. In the steam turbine according to the present invention, live steam is always admitted to the bypass control valve during operation, since the common quick-closing valve is open. On account of the leakage of the bypass control valve due to the type of construction, a slight bypass steam constantly flows through the bypass line. Conventional constant draining of the bypass line is thus avoided. In addition, the bypass line is, thus, permanently heated. This has the advantage that the conventional heating phase for the bypass line is eliminated. Accordingly, the bypass line can be put into operation immediately on demand, that is, for example, directly after ignition of the supplementary firing of the heat recovery boiler and the higher steam production caused by it. The steam turbine, thus, has an advantageously reduced control time during a short-time demand for output.

An advantageous configuration of a steam turbine is achieved if the at least one bypass control valve, the quick-closing valve and the at least one live-steam control valve are disposed in a common valve casing. In this configuration, an optimally compact and thus space-saving steam turbine configuration is achieved.

In a preferred configuration of the steam turbine, according to the present invention, the at least one bypass feed is disposed in the high-pressure region of the steam turbine: for example, from below, as viewed in the direction of the gravitational force, such that dismantling of the bypass feed is avoided during dismantling of the top part of the outer casing of the steam turbine.

The top half, as viewed in the direction of the gravitational force, of the steam turbine according to the present invention is, therefore, freely accessible, for example for maintenance work. This is especially advantageous, when performing the maintenance work, because the top outer casing can be dismantled as simply as possible.

In a steam turbine configured according to the present invention, a bypass inlet region, at which the bypass feed feeds bypass steam into the high-pressure region of the steam turbine, is freely selectable in the axial direction between two adjacent blade rows of the turbine. In this way, the desired absorption capacity of the steam turbine can be realized in a simple manner.

An advantageously uniform distribution of the bypass steam over the circumference of the steam turbine in the bypass inlet region is achieved by a torus-like annular space.

The torus-like annular space has, on the one hand, a U-shaped profile element as a boundary of the outside diameter of the torus-like annular space. The legs of the U-shaped profile element, at least partly, form its axial boundary on both sides. On the other hand, the inner casing of the steam turbine, by appropriate configuration, forms the boundary of the inside diameter of the torus-like annular space. Likewise, the axial boundary on both sides is at least partly formed by appropriate configuration of the inner casing. In this way, the torus-like annular space is advantageously formed with relatively fewer components having simple configuration.

In addition, the U-shaped profile element, with the comparatively higher bypass-steam pressure in the torus-like annular space being utilized, is configured so as to be self-sealing against the already partly expanded steam in a blade passage in the bypass inlet region of the steam turbine. Thus, a complicated sealing construction is avoided.

A further advantage of the steam turbine configured according to the present invention is: the inner casing, in the bypass inlet region, has apertures as connections between the torus-like annular space and the blade passage. These apertures are disposed and configured in such a way that a homogeneous mixing of the bypass steam from the torus-like annular space and the partly expanded steam in the blade passage is achieved in the bypass inlet region of the steam turbine. In this way, the desired homogeneous mixing of bypass steam and partly expanded steam is achieved with especially simple technical measures.

Further, according to the method of feeding bypass steam into a steam turbine the present invention, first the live steam is fed from the steam turbine via a quick-closing valve, and, is then partly fed via at least one live-steam control valve, to the turbine inlet region. In addition, the live steam can be fed partly as "bypass steam" to a bypass inlet region in the high-pressure region of the steam turbine, via at least one bypass control valve.

The steam flow is advantageously directed to the steam turbine in a simple manner, because the live steam splits up into live steam and bypass steam, downstream of a quick-closing valve. Accordingly, an additional safety fitting, namely a separate bypass quick-closing valve, is advantageously omitted.

In addition, the steam pipelines are advantageously run in a simplified manner. Accordingly, it is possible to plan a more compact configuration of the steam turbine.

The overall bypass efficiency is improved, since a component causing the flow resistance, namely the bypass quick-closing valve, is thereby omitted. In addition, the requisite length of the steam pipelines is advantageously shortened.

In a further advantageous of the method according to the present invention, the bypass steam is fed into the high-pressure region of the steam turbine, via a bypass line and via a bypass feed, although the bypass steam is not fed in until after the first turbine moving-blade row, which follows downstream of the steam-turbine inlet region.

Accordingly, only one bypass line and one bypass feed are provided, thus, ensuring a simple and short pipeline run. This, moreover, keeps the pressure losses between bypass control valve and steam turbine low.

Other features which are considered as characteristic for the present invention are set forth in the appended claims.

Although the present invention is illustrated and described herein as embodied in a steam turbine and a method of feeding bypass steam, it is nevertheless not intended to be limited to the details shown, since various modifications and structural changes may be made therein without departing from the spirit of the present invention and within the scope and range of equivalents of the claims.

The construction and method of operation of the present invention, however, together with additional objects and advantages thereof will be best understood from the following description of specific embodiments when read in connection with the accompanying drawings.

DESCRIPTION OF THE PREFERRED EMBODIMENTS

Figure 1:
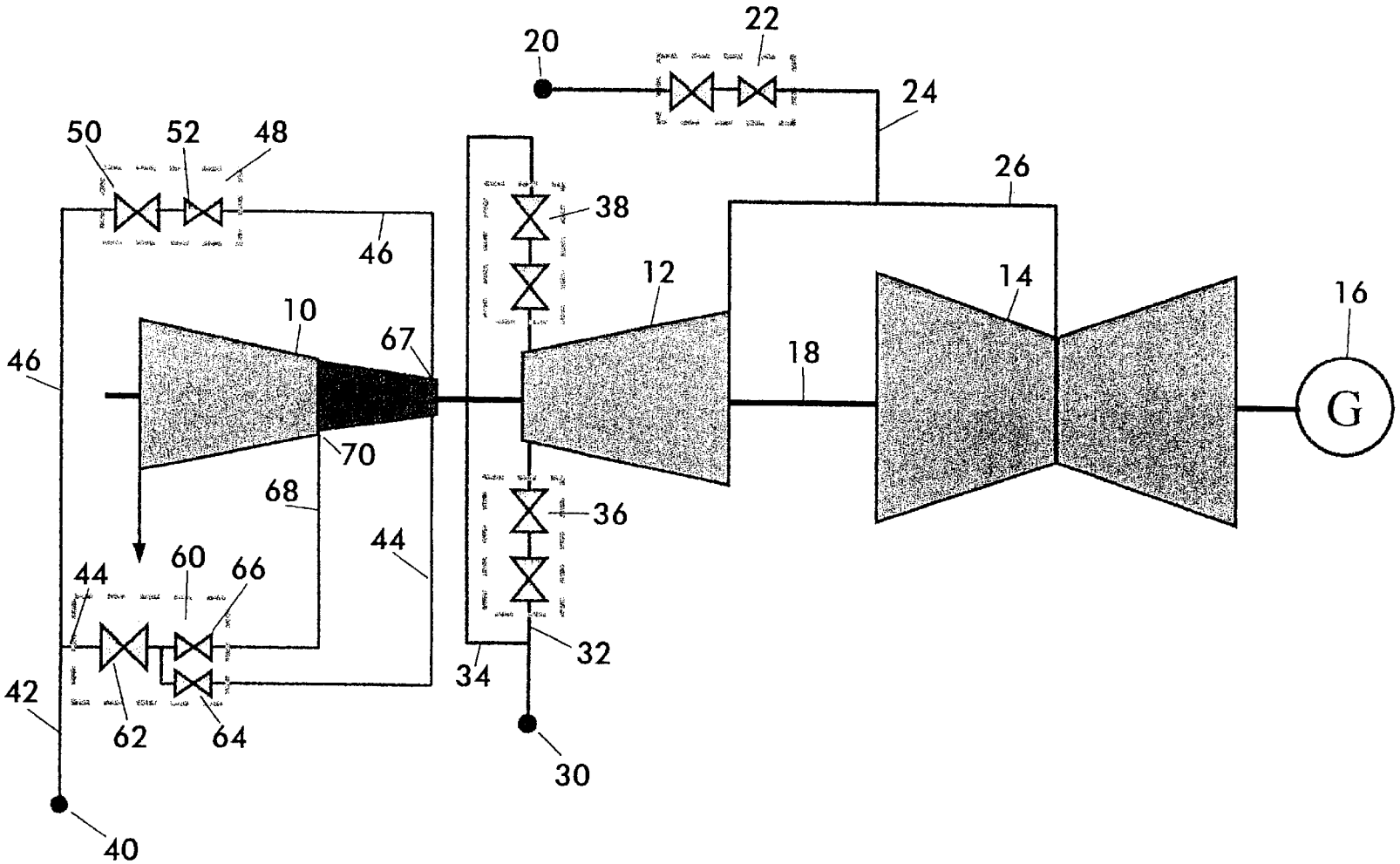
FIG. 1 is a process schematic of a steam turbine.

In all the figures of the drawing, sub-features and integral parts that correspond to one another bear the same reference symbol in each case.

Referring now to the figures of the drawings in detail and first, particularly to FIG. 1 thereof, there is shown a process schematic of a triple-cylinder steam turbine having a high-pressure turbine section 10, an intermediate-pressure turbine section 12 and a low-pressure turbine section 14, which are disposed together with a generator 16 to form a shaft line 18.

From a first steam source 20, steam can be fed via a first valve combination 22, through a first steam line 24 into an overflow line 26. The overflow line 26 connects a steam discharge region of the intermediate-pressure turbine section 12 to an inlet region of the low-pressure turbine section 14.

From a second steam source 30, a steam flow is fed through the steam lines 32 and 34 to two additional valve combinations 36, 38. The two valve combinations 36, 38 control the partial flows of the steam flow, which are fed to them. Then, the two valve combinations 36, 38 feed the corresponding controlled partial flows to a respective location in the inlet region of the intermediate-pressure turbine section 12. The feeding of the partial flows is affected, at any rate, upstream of a first moving blade row of the intermediate-pressure turbine section 12, as viewed in the direction of flow of the steam.

A live-steam source 40 supplies steam to the high-pressure turbine section. The live steam from the live-steam source 40 is fed through a live-steam main line 42, which branches into two live-steam lines 44, 46. Accordingly, the live-steam main line 42 branches into a first live-steam valve combination 48, which, as viewed in the direction of flow of the steam, has a first quick-closing valve 50 and a first control valve 52. Further, the live-steam main line 42 branches into a second live-steam valve combination 60, which, as viewed in the direction of flow of the steam, has a second quick-closing valve 62, a second control valve 64, and a bypass valve 66 that is disposed parallel to the second control valve 64.

Next, the corresponding partial flow of the live steam from the first or the second control valve 52, 64, is fed via the live-steam lines 44, 46 into the inlet region 67 of the high-pressure turbine section 10. The feeding of the live-steam partial flows is also affected, in each case, upstream of the first moving blade row of the high-pressure turbine section 10, as viewed in the direction of flow of the live steam. Next, the bypass line 66 directs, a bypass steam flow, through the bypass line 68 to a bypass inlet region 70. The bypass inlet region 70 is located in the region of the high-pressure turbine section 10 and feeds the steam flow into the high-pressure turbine section 10.

The method according to the present invention, accordingly, is carried out as follows: the live steam is fed to the second quick-closing valve 62; when the second quick-closing valve 62 closes, the two valves which are disposed downstream of the second quick-closing valve 62, namely the second control valve 64 and the bypass control valve 66, no longer receive any live steam. This is a considerable advantage compared with the conventional valve arrangements, since a separate bypass quick-closing valve, which is assigned solely to the bypass control valve 66, is advantageously omitted. The steam flow is advantageously directed to the turbine in a simplified and in an economical manner.

During the operation of the steam turbine, the live steam is split, downstream of the second quick-closing valve 62. A portion is directed, as live steam, to a turbine inlet of the high-pressure turbine section 10. Another portion of the live steam is directed, as "bypass steam" to the bypass inlet region 70 through the bypass line 68. The "bypass steam", however, has essentially the steam state of the live steam.

Figure 2:
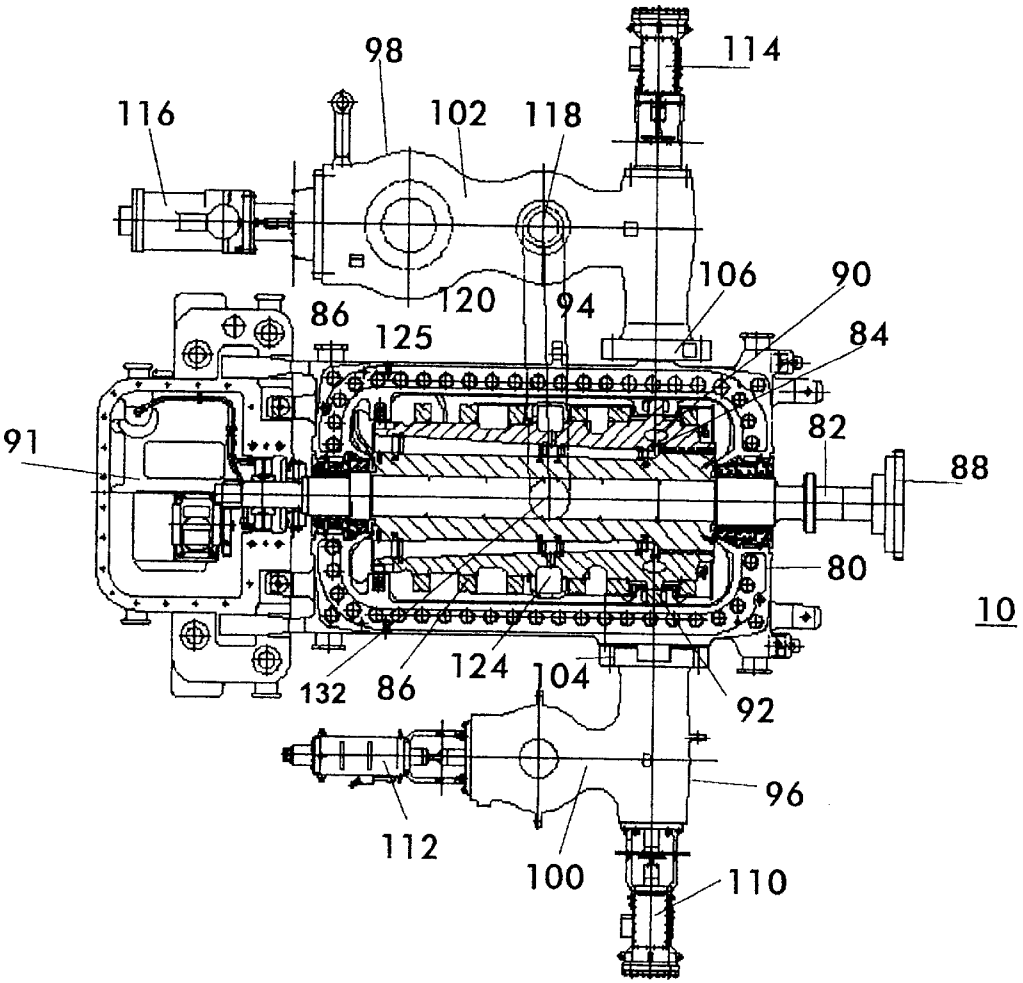
FIG. 2 is a sectional plan view, which illustrates a high-pressure turbine section.

Referring now to FIG. 2, a turbine shaft section 82 is disposed in a casing bottom part 80. The turbine shaft section 82 is received at its one end through the casing bottom part 80 and terminates with a flange 88. The turbine shaft section 82 also interacts, at an opposite shaft end, with a shaft turning device 91. The turbine shaft section 82 ends in a region of the shaft turning device 91. For clarity, the guide and the moving blade components of the high-pressure turbine section 10 are not shown in FIG. 2. However, they are located between the turbine shaft section 82 and an inner casing 84, which is held together by a number of shrink rings 86.

A turbine inlet region is disposed in the inner region of the high-pressure turbine section 10 facing the flange 88. The turbine inlet region is provided as a torus-like steam inlet element 90 with two steam inlet ports 92, 94. The steam inlet element 90 is configured, in the region of the steam inlet ports 92, 94, such that it passes, in each case, through the outer casing. The steam inlet element 90 is connected, in each case, to the live-steam-carrying component, of a first valve combination 96 and of a second valve combination 98, although this is not shown. In FIG. 2, the two valve combinations 96, 98 are shown in plan view. Therefore, the corresponding connecting flanges 104, 106 are shown as the connections between the casing of the high-pressure turbine section, and the first and second valve casings 100 and 102 respectively.

The first valve combination 96 has a first control valve and a first quick-closing valve. The first control valve has a first control-valve drive 110, which is supported on the first valve casing 100. The first quick-closing-valve has a first quick-closing-valve drive 112, which is, likewise, supported on the first valve casing 100. The first control valve and the first quick-closing valve are disposed together in the first valve casing 100.

The second valve combination 98 is constructed in a manner, which is partially comparable, to the first valve combination 96. The second valve combination 98 is constructed with a second control valve, a second control-valve drive, a second quick-closing valve, and a quick-closing-valve drive 116, disposed in the common second valve casing 102. In addition, a bypass valve, having a bypass-valve drive 118 assigned to it, is disposed in the second valve casing 102; that is, the bypass valve is disposed between the second quick-closing valve and the second control valve in the live-steam path.

A bypass-steam line 120 connects a bypass-valve outlet 130 (concealed in this view, but see FIG. 3) to a bypass feed 132 on the high-pressure turbine section. The bypass feed 132 is specified by a circle 132 in FIG. 2 (but, see FIG. 3). Further, a torus-like annular space 124 is disposed between two adjacent shrink rings 86 and approximately centrally relative to the inner casing 84, as viewed in the axial direction of the turbine shaft section 82. The torus-like annular space 124 is formed partly by an appropriate configuration of the inner casing 84 and by an annular U-shaped profile element 125.

Accordingly, an advantageous configuration of the present invention is shown here. In this configuration, first, the second quick-closing valve as viewed in the direction of flow of the live steam, and, subsequently, the bypass control valve and the second control valve are disposed in the common valve casing 102.

Figure 3:
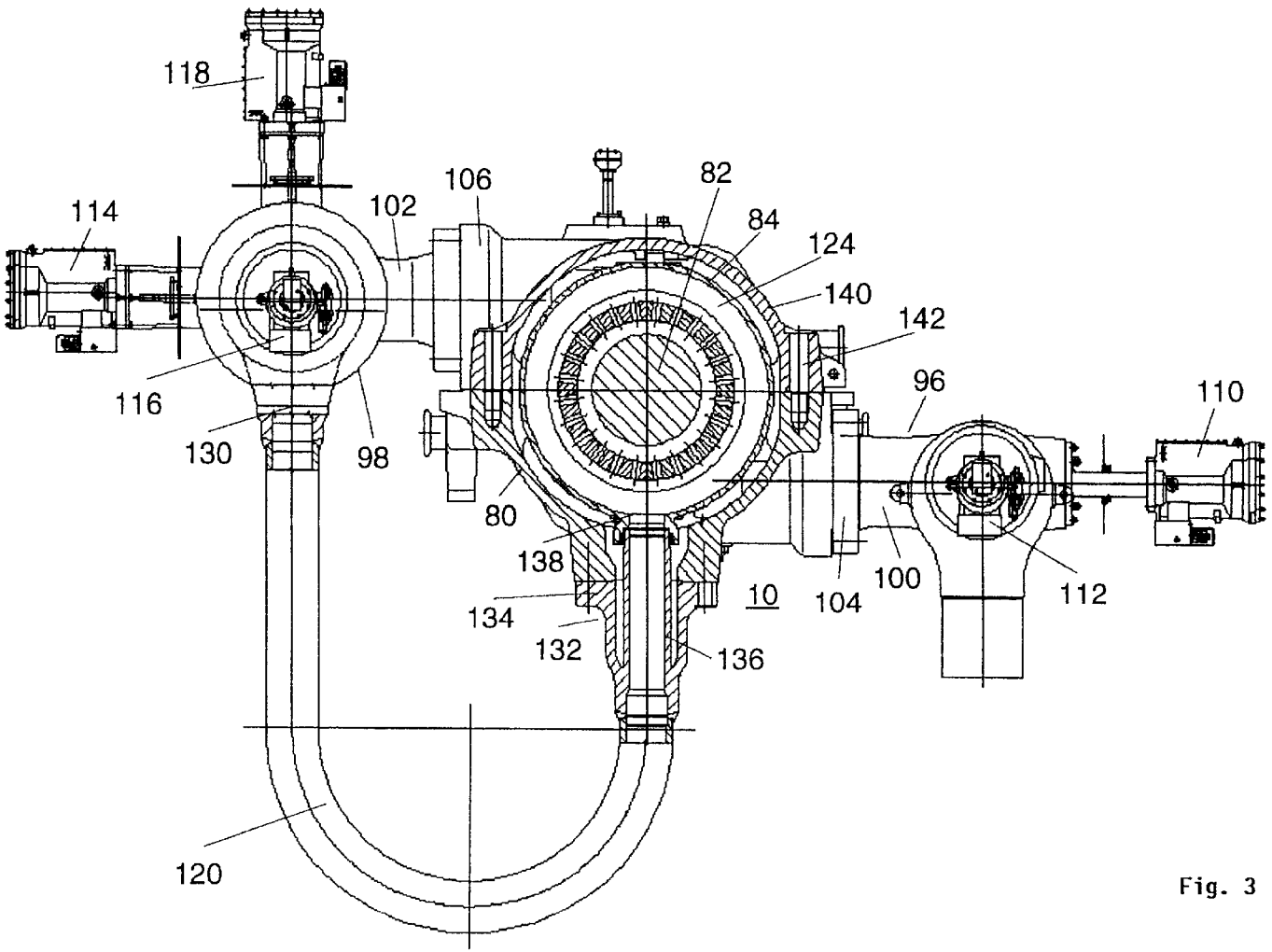
FIG. 3 illustrates a sectional view, which is perpendicular to the center line of the turbine shaft section of the high-pressure turbine section.

Referring now to the figures of the drawings in detail and first, particularly to FIG. 3 thereof, there is shown a sectional view, perpendicular to the center line of the turbine shaft section 82, of the high-pressure turbine section 10. However, the section illustrates only a region of the high-pressure turbine section 10, in which the torus-like annular space 124 is disposed. Accordingly, the flange-mounted first and second valve combinations 96, 98 are only shown in an external view.

FIG. 3 shows, in particular, the bypass valve outlet 130 and the bypass feed 132. The bypass feed 132 adjoins the bypass-steam line 120 on a first end. On a second end, the bypass feed 132 is flange-mounted on the casing bottom part 80 through an outer bypass-feed element 134. The bypass feed 132 is connected to a connection element 138 of the torus-like annular space 124 through an inner bypass-feed element 136.

Further, a casing top part 140 of the outer casing is shown. The casing top part 140 is connected to the casing bottom part 80 through a flange connection 142.

Figure 4:
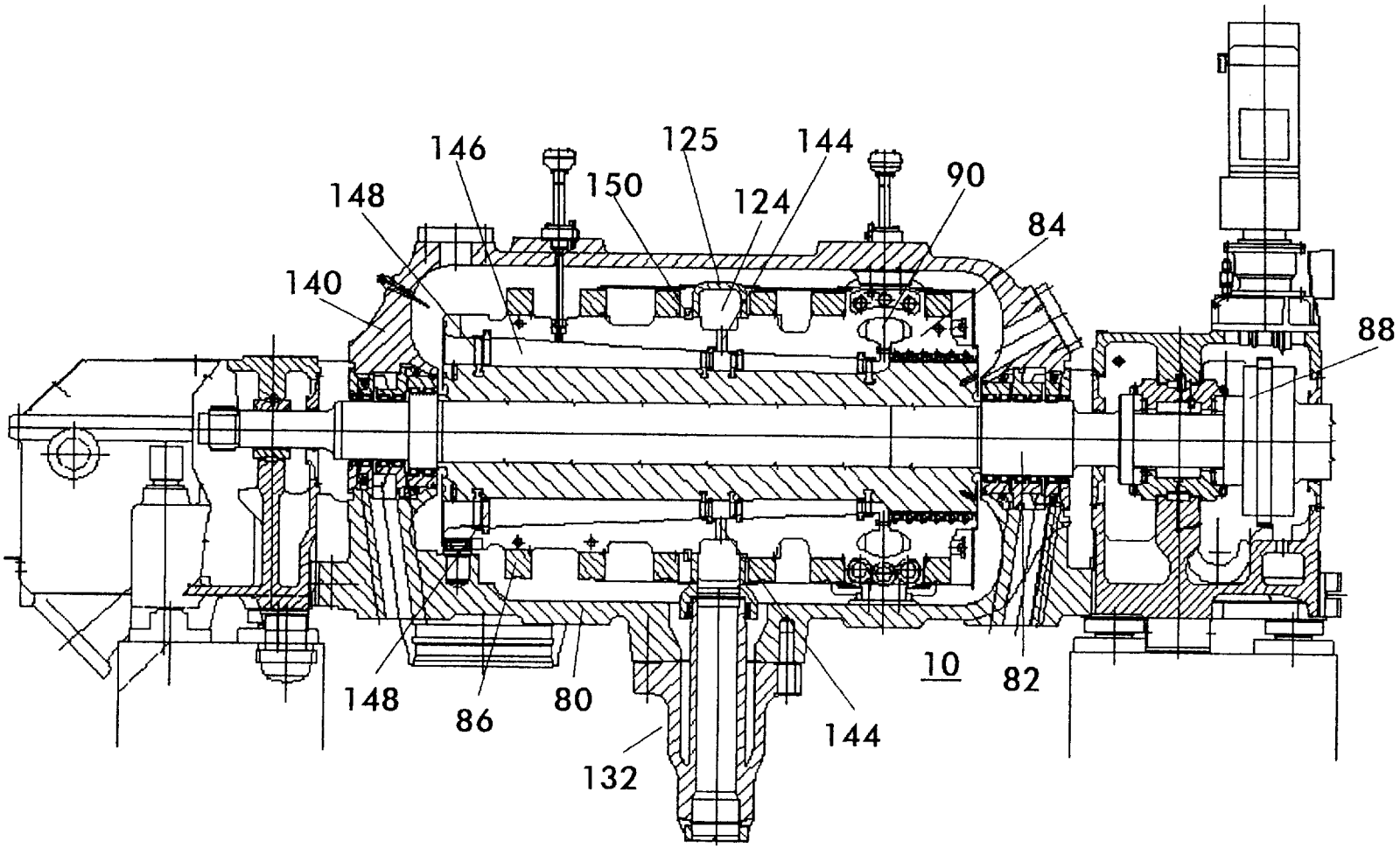
FIG. 4 illustrates a longitudinal sectional view through the high-pressure turbine section.
Figure 5:
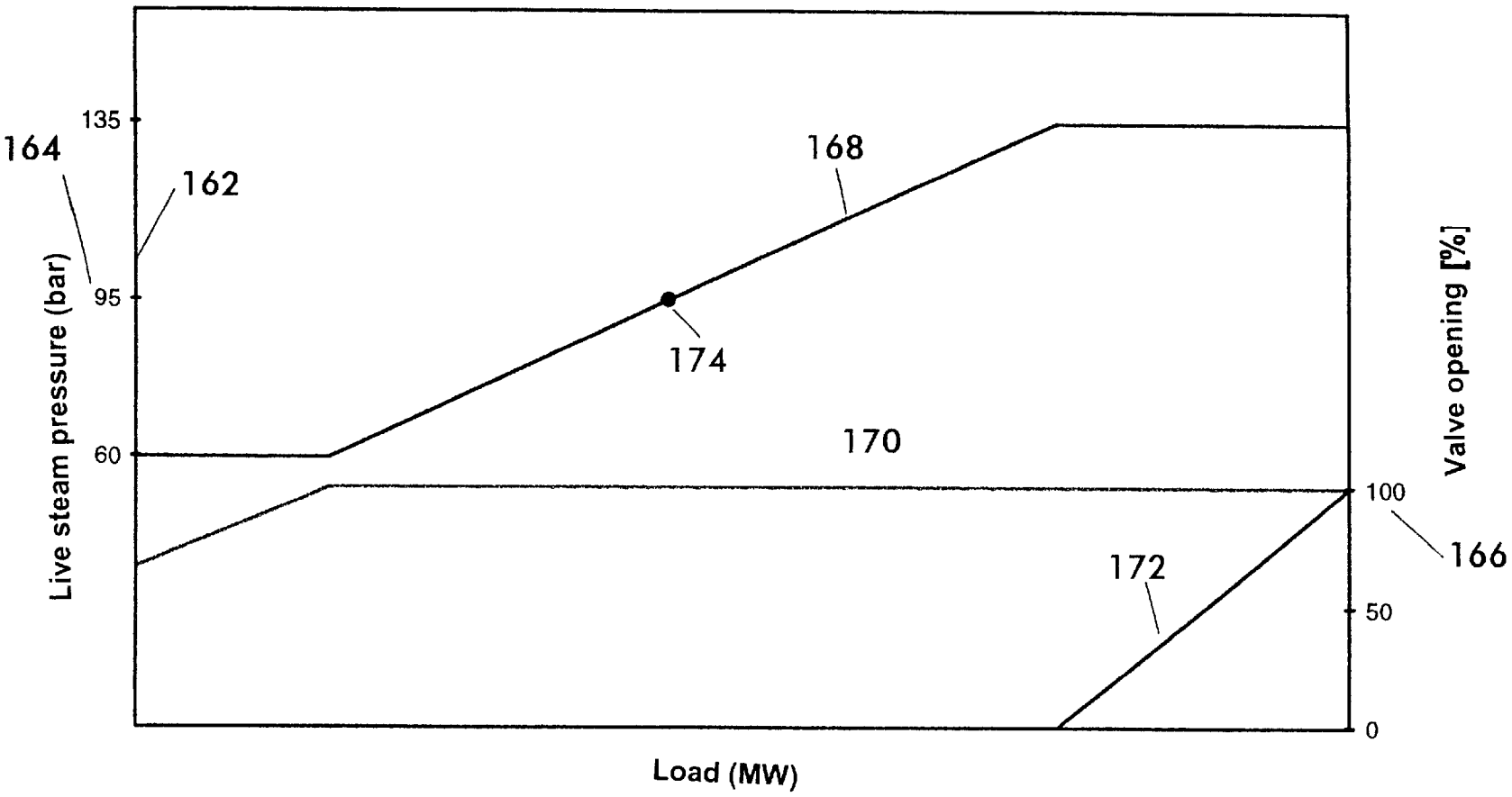
FIG. 5 is a graph, which illustrates a control concept for a steam turbine.

Referring now to the figures of the drawings in detail and first, particularly to FIG. 4 thereof, there is shown a longitudinal sectional view of the high-pressure turbine section 10.

A blade passage 146 is disposed between the inner casing 84 and the turbine shaft section 82. Both the guide blade and the moving blade are disposed in the blade passage 146. However, they are only indicated, locally, as blades 148.

The torus-like annular space 124 has apertures 144 at its inner diameter. The bypass steam is fed from the torus-like annular space 124 into the blade passage 146 via the apertures 144. Homogeneous mixing of the steam, which is already present in the blade passage 146, with the "bypass steam", which is fed in, is achieved by selecting a suitable number and a suitable configuration of the apertures 144.

Accordingly, a temperature distribution in the region of the mixing is achieved by selecting a suitable configuration of the torus-like annular space 124. The temperature distribution enables standard materials to be used. Additionally, the shaft construction and the bearing construction of the high-pressure turbine section 10 advantageously remain unchanged.

The aforementioned view shows how the self-sealing mechanism acts at the U-shaped profile element 125. The two legs of the U-shaped profile element 125 are disposed between two adjacent shrink rings 86. The part of the U-shaped profile element 125, which connects the legs, defines the boundary at the outside diameter of the torus-like annular space. A spacer 150 is disposed between one of the legs and the shrink ring that is assigned to one of the legs, such that the U-shaped profile element 125 is positioned axially. The pressure in the torus-like annular space 124 corresponds to the bypass-steam pressure, and, therefore, has virtually live-steam pressure parameters. This pressure is higher than the steam pressure in the blade passage at the relevant location, since the steam in the blade passage has already been partly expanded on its way from the steam inlet element 90 to the relevant location. Accordingly, the legs, due to the internal pressure, are provided with an action of force, in each case, preferably in the axial direction, and are sealed so as to be clamped against the seat of the U-shaped profile element. With the increasing pressure difference between the internal pressure and the blade-passage pressure, the clamping effect increases. Thus, the tightness at the relevant location increases.

Referring now to the figures of the drawings in detail and first, particularly to FIG. 1 thereof, there is illustrated, a control concept for a steam turbine in the form of a graph, according to the present invention. An output (MW), for example, the electrical output at the generator of the turbine, is plotted on the x-axis 160. Dimensional specifications are absent at the x-axis 160, since only qualitative statements are to be made. A y-axis 162 is provided with a first scale 164 for the live-steam pressure, and with a second scale 166 for the percentage opening of valves.

Accordingly, three curves are plotted: a first curve 168 relating to the live-steam pressure, a second curve 170 relating to the percentage opening of the control valves, and a third curve 172 relating to the percentage opening of the bypass control valve.

In the example shown, the control valves are about 70% open at a live-steam pressure of 60 bar. With increasing output—but at the same live-steam pressure—the control valves open in a continuously linear manner until they are completely open. In order to achieve a higher output, the live-steam pressure is linearly increased only after this point on the output scale. A 100% load case 174 is achieved at a 95 bar live-steam pressure.

The live-steam pressure can be further increased linearly up to a design limit, for example, of the heat recovery steam boiler, a maximum of 135 bar, in order to achieve a maximum output at 135 bar. Conventional combined-cycle power plants are limited, under the corresponding conditions, to this maximum output value. In the present invention, after this point on the output scale, the bypass control valve begins to open and permits an increase in the steam mass flow at constant live-steam pressure. This results in an increase in the output until the bypass control valve is completely open, and, thus, until the maximum output of the steam turbine according to the present invention is reached.

We claim:

1. A steam turbine comprising:

at least one valve arrangement having at least one quick-closing valve and at least one live-steam control valve assigned to said quick-closing valve;

a steam-turbine inlet region, a high-pressure region, and a first turbine moving-blade row;

a live-steam bypass having at least one bypass line and a bypass feed coupled to said bypass line, said live-steam bypass feeding live steam as bypass steam into said high-pressure region, after said first turbine moving-blade row, as viewed downstream of said steam-turbine inlet region; and at least one bypass control valve assigned, together with said live-steam control valve, to said at least one quick-closing valve.

2. The steam turbine according to claim 1, wherein said at least one bypass control valve, said at least one quick-closing valve and said at least one live-steam control valve are disposed in a common valve casing.

3. The steam turbine according to claim 2, wherein said live-steam bypass includes precisely one bypass line and precisely one bypass feed.

4. The steam turbine according to claim 1, wherein said live-steam bypass includes precisely one bypass line and precisely one bypass feed.

5. The steam turbine according to claim 1, further comprising a top steam-turbine outer casing.

6. The steam turbine according to claim 5, wherein said at least one bypass feed is disposed in said high-pressure region such that a dismantling of said bypass feed is avoided during a dismantling of said top steam-turbine outer casing.

7. The steam turbine according to claim 1, further comprising:

at least two adjacent blade rows; and a bypass inlet region, said bypass feed feeding bypass steam into said high-pressure region through said bypass inlet region, said bypass inlet region being freely selectable in an axial direction between said two adjacent blade rows.

8. The steam turbine according to claim 1, further comprising:

a torus-like annular space with an outside diameter and an inside diameter;

a U-shaped profile element;

an inner casing;

a turbine shaft section; and a blade passage disposed between said inner casing and said turbine shaft section.

9. The steam turbine according to claim 8, wherein said bypass steam is uniformly distributed over a circumference in said bypass inlet region by said torus-like annular space.

10. The steam turbine according to claim 8, wherein said torus-like annular space is formed by said U-shaped profile element defining a boundary of said outside diameter and at least a partial axial boundary on both sides.

11. The steam turbine according to claim 8, wherein said torus-like annular space is formed by an appropriate configuration of said inner casing for defining a boundary of said inside diameter and at least a partial axial boundary on both sides.

12. The steam turbine according to claim 8, wherein said U-shaped profile element, when a bypass-steam having a comparatively higher bypass-steam pressure in said torus-like annular space is utilized, is configured so as to be self-sealing against a partly expanded steam in said blade passage in said bypass inlet region.

13. The steam turbine according to claim 12, wherein said inner casing, in said bypass inlet region, includes apertures, said apertures being disposed as at least one connection between said torus-like annular space and said blade passage, and said apertures being disposed and configured such that a homogeneous mixing of said bypass steam bypass-steam having a comparatively higher bypass-steam pressure from said torus-like annular space and said partly expanded steam in said blade passage is achieved in said bypass inlet region.

14. A method of feeding bypass steam into a steam turbine, which comprises:

controlling a live steam through at least one valve arrangement;

feeding the live steam via a quick-closing valve;

partially feeding the live steam to a turbine inlet region via at least one live-steam control valve;

partially feeding the live steam as bypass steam to a bypass inlet region in a high-pressure region of the steam turbine via at least one bypass control valve.

15. The method according to claim 14, wherein the bypass steam is fed into a high-pressure region via a bypass line and via a bypass feed, although the bypass steam is not fed in until after a first turbine moving-blade row, which follows downstream of the steam-turbine inlet region.

16. The method according to claim 15, wherein the bypass steam is uniformly distributed over a circumference of the steam turbine by a torus-like annular space in the bypass inlet region.

17. The method according to claim 14, wherein the bypass steam is uniformly distributed over a circumference of the steam turbine by a torus-like annular space in the bypass inlet region.

18. The method according to claim 14, which further comprises feeding the bypass steam from a torus-like annular space into a blade passage via a plurality of apertures.

19. The method according to claim 14, which further comprises controlling a mixing of the bypass steam and a partly expanded steam in a blade passage by a configuration of the apertures.

20. The method according to claim 14, which further comprises controlling a mixing of the bypass steam and a partly expanded steam in a blade passage by a quantity and a position of the apertures.

* * * * *